United States Patent [19]

Hasenfus

[11] Patent Number: 4,471,869

[45] Date of Patent: Sep. 18, 1984

[54] WET CANVAS CARRYING CASE

[76] Inventor: Richard C. Hasenfus, 1016 High St., Bath, Me. 04530

[21] Appl. No.: 420,121

[22] Filed: Sep. 20, 1982

[51] Int. Cl.[3] ..... B44D 3/00

[52] U.S. Cl. ..... 206/1.7; 206/454; 206/461

[58] Field of Search ..... 206/45.34, 454, 453, 206/477, 461, 555, 1.7; 312/231; D28/73

[56] References Cited

U.S. PATENT DOCUMENTS

| | | | |
|---|---|---|---|
| 1,175,070 | 3/1916 | Maxwell | 206/1.7 |
| 2,221,024 | 11/1940 | Hood | 206/561 |
| 2,648,933 | 8/1953 | Brooks et al. | D28/73 |
| 2,804,226 | 8/1957 | Freedman | 206/1.7 |
| 2,950,001 | 8/1960 | Bucko | 206/477 |
| 3,533,502 | 10/1970 | Hansen | 206/453 |
| 4,029,208 | 6/1977 | Fickler et al. | 206/454 |
| 4,061,224 | 12/1977 | Fuhri | 220/22 |
| 4,072,230 | 2/1978 | Mulligan | 206/454 |
| 4,086,263 | 4/1978 | Rowley | 206/454 |

*Primary Examiner*—William Price
*Assistant Examiner*—David Fidei
*Attorney, Agent, or Firm*—N. J. Aquilino

[57] ABSTRACT

A carrying case for art canvases adapted to accommodate various size canvases, including a horizontally adjustable support means for engaging a canvas preventing movement in a horizontal direction and a vertically adjustable support for engaging a canvas preventing movement in a vertical direction.

9 Claims, 6 Drawing Figures

WET CANVAS CARRYING CASE

BACKGROUND OF THE INVENTION

The present invention relates to an artist's carrying case, and in particular to a carrying case adapted to carry wet canvases, painting panels, or canvas boards of any size.

A number of professional and amateur artist paint at on-site locations rather than in a studio on an easel. This presents problems particularly when the artist uses oil, acrylic, or similar painting materials which takes substantial periods of time to dry after they are applied to the canvas. Each time a wet canvas or wet panel is moved, a danger exists of having the painting smeared with the wet paint. Not only can a painting be ruined, but substantial damage to clothing, upholstery, and so forth may occur from the paints. The boxes and cases that have been developed for carrying art supplies and paintings have not been satisfactory for carrying wet canvases. Most of these cases include slots which are adapted to receive only a single size canvas of a specific width. Most of these are not suitable for carrying stretched canvases, painting panels, or canvas boards, or for canvases of varying size.

Examples of cases of this type are shown in the patents to Maxwell, 1,175,070; Brooks et al, 2,648,933; and Fuhri, 4,061,224.

The present invention provides a wet canvas carrying case which solves the problems described above, and which is useful for carrying both wet and dry stretched canvases, painting panels, or canvas boards, of any size. The canvases are securely held in place by a unique holding arrangement, including an adjustably positioned u-shaped holder block which is horizontally slideable on a track. The holder block also includes a vertically adjustable sliding rod having a bent over finger which engages the top of the canvas or panel to eliminate movement in an upward direction. Because the holder block is adjusted horizontally and the sliding rod is adjustable vertically, the carrying case of the present invention can accomodate a varying number of sizes of art canvases.

The carrying case also provides a convenient means for carrying dry canvases or other valuable paintings. The carrying case preferably is designed to accomodate a plurality of paintings, although it will be appreciated that the invention is equally applicable to a carrying case for a single canvas.

Among the objects of the present invention are the provision of a carrying case which permits an artist to carry one or more wet canvases while maintaining them in a secure position eliminating the danger of wet paints being smeared or otherwise ruined.

Another object of the present invention is to provide a carrying case for wet canvases particularly adapted to accomodate a large variety of sizes of canvases.

Still a further object of the present invention is to provide an artist carrying case in which the canvas holding means is easily adjustable without the need of special tools and equipment.

A still further object of the invention is to provide a carrying case which is constructed economically, but which provides a firm and sturdy holding means for holding wet canvases in place.

Other objects of the present invention will become apparent by referring to the accompanying drawings and specification.

DESCRIPTION OF THE PREFERRED EMBODIMENTS

Figure 1:
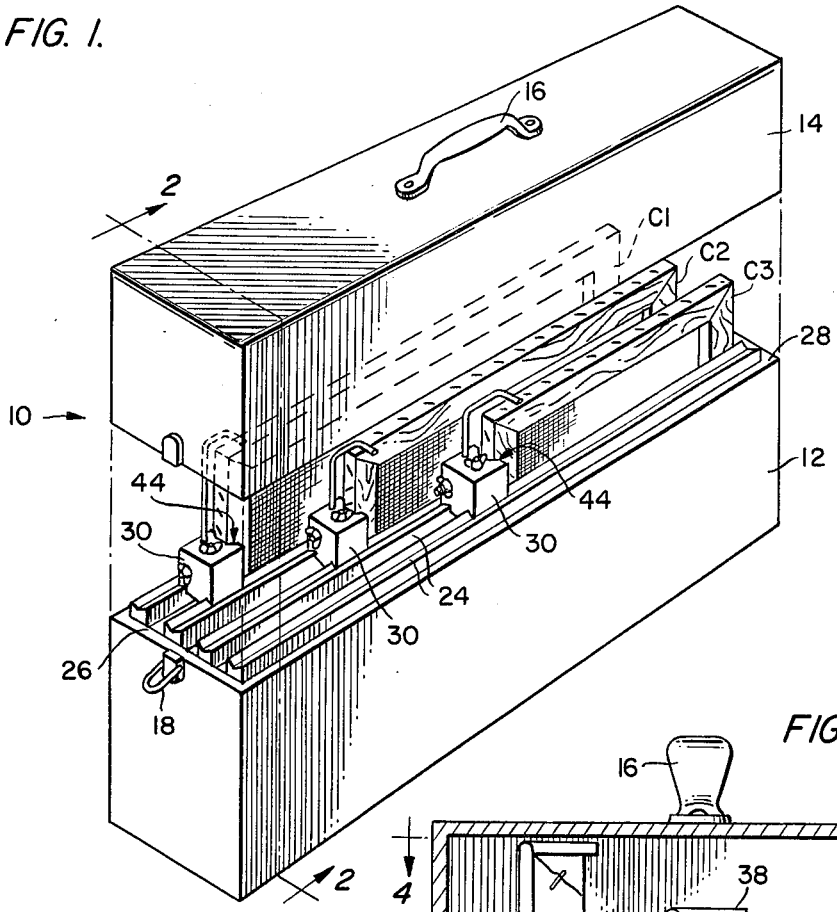
FIG. 1 shows the prospective view of the carrying case of the present invention with cover lifted.

The artist carrying case 10 of the present invention is shown in the drawings. FIG. 1 shows the case 10 as a generally rectangular box type structure including a lower section 12 and an upper section or cover 14. The case includes a handle 16 and a suitable latch means 18. The case 10 shown provides carrying spaces for three canvases C1, C2 and C3. Each canvas is shown as being of different size for the purpose of demonstrating the versitility of the invention, however, the case can accomodate from one to any manageable number of canvases of the same size or various different sizes.

The case 10 includes a bottom floor 20, side walls 22, and end walls 26 and 28. A plurality of tracks 24, which are key-shaped in cross-section, are suitably secured to the end walls 26 and 28 of the case.

The tracks are located at the point where the cover 14 and base 12 separate for easy accessability.

Figure 2:
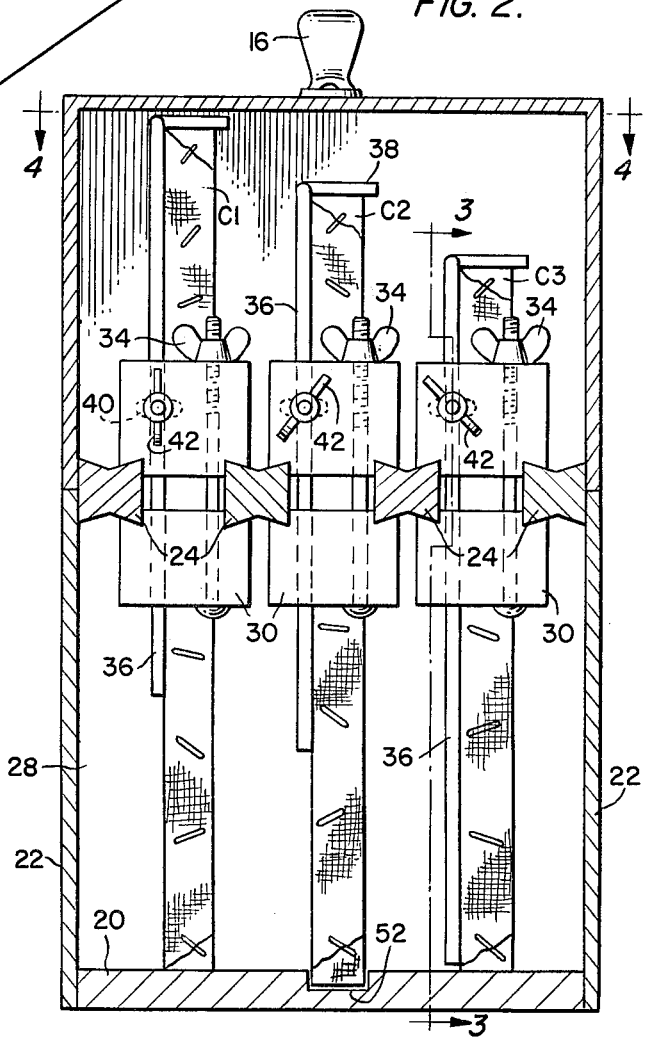
FIG. 2 is a side sectional view taken along the lines 2—2 of FIG. 1.
Figure 3:
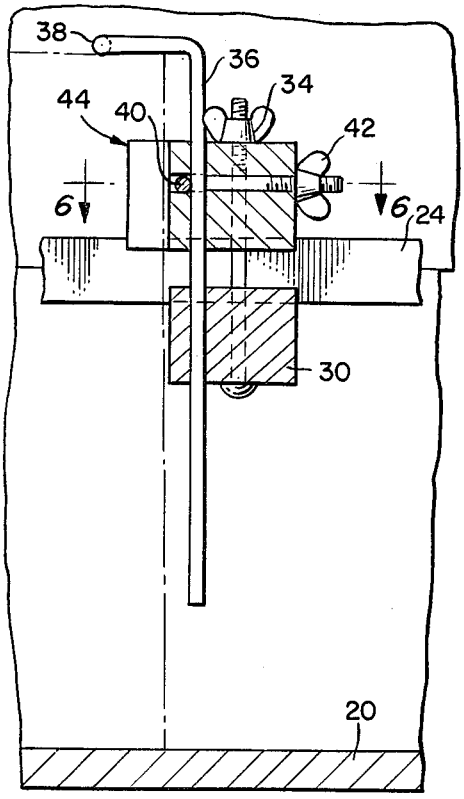
FIG. 3 is a partial view of the carrying case taken along the line 3—3 of FIG. 2.
Figure 4:
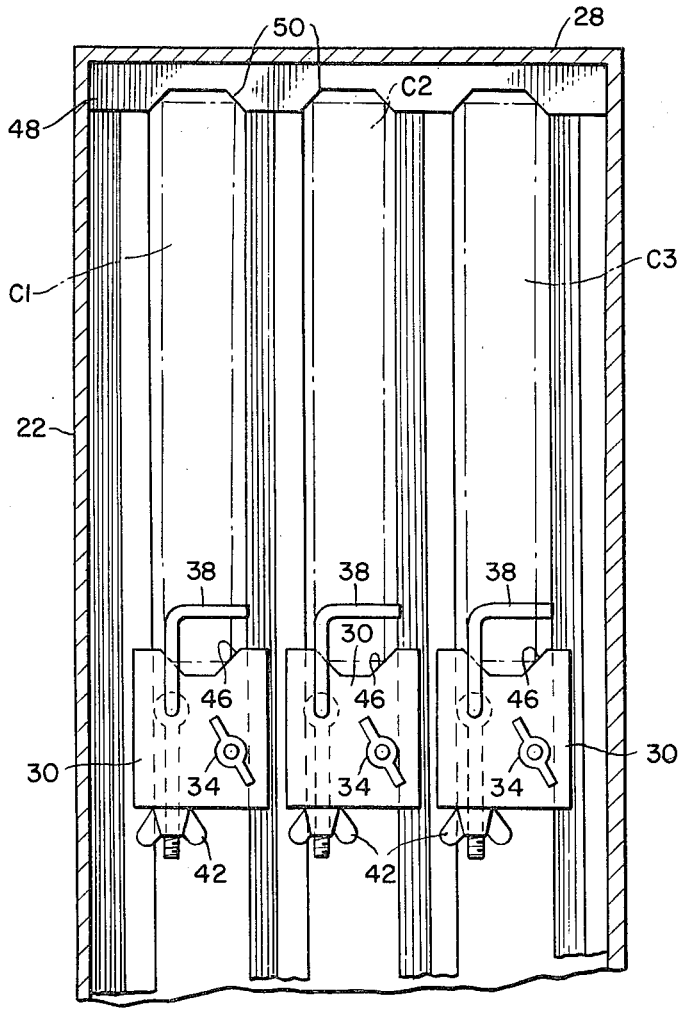
FIG. 4 is a partial plan view of the carrying case taken along the line 4—4 of FIG. 2.
Figure 5:
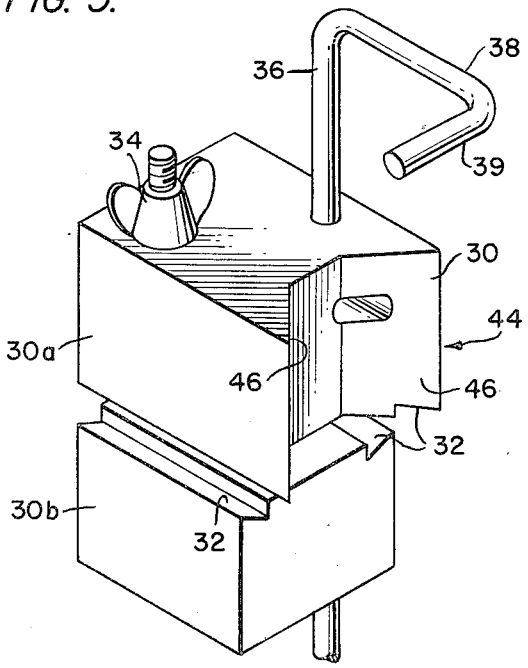
FIG. 5 is a detail of the holder arrangement of the carrying case of the present invention.
Figure 6:
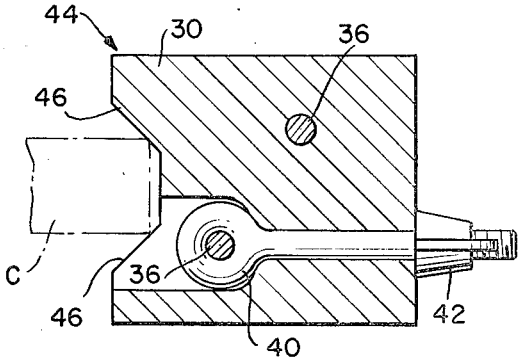
FIG. 6 is a sectional detail of the holder of the present invention taken along the line 6—6 of FIG. 3.

Each track is designed to accomodate a holder block 30, shown in detail in FIGS. 5 and 6. Each block 30 is formed in two pieces **30*a* and 30*b*. The lower part of piece 30*a* and the upper part of piece 30*b* are both formed with slots 32 which are shaped to fit and engage the outer sections of the tracks 24 as shown in FIG. 2. The holder blocks 30 are slideable along the tracks 24 in a longitudinal direction between the end walls 26 and 28 of the case 10. The end of the block 30 is u-shaped support 44 and has legs 46** which form a recess which accomodates the end of a canvas to secure it against movement as described hereinbelow.

Each block 30 is provided with a bolt and wing nut fastener 34 which is used to screw together the two pieces **30*a* and 30*b* of the block 30, thus tightening the block on a track 24 at a preferable desired location. Each block 30 also serves to mount a vertical sliding rod 36 having an upper finger 38, including an end 39, which is bent away from the vertical and forms an engaging surface for the side of a canvas panel. The vertical rod 36 is kept in place in the block 30 by means of an eye bolt 40 secured by a wing nut 42. The end 39 of the rod 36** may be curved to accomodate the edge of various smaller size canvases or panels.

The end walls 28 of the case 10 are provided with a support 48 which also includes grooves 50 to position and support the other end of a canvas C to prevent its movement.

The carrying case 10 may also be provided with grooves 52 in the bottom floor 20 into which a canvas or panel may fit to increase stability, although when the case is used under normal conditions the grooves 52 are not necessary since the horizontal and vertical supports maintain the canvases in position.

In use, a wet canvas or panel would be placed into the bottom floor 20 of the case 10. If grooves 52 are provided, the canvas would be positioned in a groove. One end of the canvas is fitted into a groove 50 to secure that end. With the pieces 30*a* and 30*b* of the holder block 30 separated, the block is easily slid along one of the tracks 24 in a longitudinal manner so that the block 30 and its corresponding u-shaped support 44 are moved until the other end of the canvas rests in the recess formed by the legs 46 of the block 30. The block is then tightened in position on the track 24 using the bolt and wing nut fastener 34. This secures the canvas against horizontal movement within the case. The vertical rod 36 is then moved in a vertical direction until the horizontal end 39 of the finger 38 engages the top of the canvas as shown in the drawings. The wing nut 42 is then fastened causing the bolt 40 to pull against the vertical rod 36 thereby locking it in position. This secures the canvas against vertical movement. With this arrangement, a canvas C is prevented from upward, downward, and sideward movement by means of the adjustable engageing devices described hereinabove. The case 10 is so constructed so as to provide sufficient amounts of room between each canvas to virtually eliminate the smearing or other destruction of wet paint on the canvas surface.

It will be appreciated that the above description is not considered limiting, but that many changes may be made to the present invention within the scope of the following claims.

What I claim is:

1. A carrying case for art canvases having an interior carrying chamber formed by a bottom surface, side walls, end walls, and a cover, wherein the improvement comprises means for supporting art canvases of varying size, said supporting means including at least one horizontal track member disposed between said end walls and spaced above said bottom surface and support blocks carried by said horizontal track member and longitudinally moveable along the length of said track; said support blocks including a canvas engaging means adapted to engage a canvas in a horizontal direction and moveable horizontally along said track and a vertically adjustable canvas engaging means adapted to engage a canvas in a vertical direction whereby said horizontal engaging means of said support block engages one side of a canvas and maintains it securely against one of said end walls and said vertically adjustable engaging means of said support block engages the top of a canvas and maintains it securely against said bottom surface of said carrying case.

2. The case of claim 1 wherein said horizontal engaging means is a U-shaped recess formed by one side of said support block; said recess being open in a direction perpendicular to the longitudinal axis of said horizontal track.

3. The case of claim 2 wherein said support block further includes grooves adapted to engage said horizontal track permitting said support block to ride on said track and be horizontally adjustable along the length of said track.

4. The case of claim 1 wherein said vertically adjustable engaging means is a rod member mounted in the top of said support block and extending upwardly above said block.

5. The case of claim 4 wherein said rod member is vertically moveable in said support block and includes an upper engaging finger adapted to engage the top surface of a canvas positioned in said case.

6. The case of claim 5 further including a clamping means attached to said support block to maintain said rod member at a selected vertical position.

7. The case of claim 1 further including first groove means in one of said end walls adapted to receive and position the second end of said canvas.

8. The case of claim 7 further including second groove means in said bottom surface of said case.

9. The case of claim 1 further including groove means in said bottom surface of said case to engage said bottom of said canvas.

* * * * *